United States Patent [19]

Rosenberg

[11] Patent Number: 4,660,765

[45] Date of Patent: Apr. 28, 1987

[54] WATER SPRINKLER

[76] Inventor: Peretz Rosenberg, Moshav Beit Shearim, Israel

[21] Appl. No.: 752,069

[22] Filed: Jul. 5, 1985

[30] Foreign Application Priority Data

Jul. 20, 1984 [IL] Israel ..... 72463

[51] Int. Cl.[4] ..... B05B 3/04; B05B 1/34; B05B 1/26; A62C 31/02

[52] U.S. Cl. ..... 239/222.17; 239/222.11; 239/383; 239/390; 239/396; 239/464; 239/505

[58] Field of Search ..... 239/222.11, 222.17, 239/222.21, 380, 381, 390, 391, 396, 397, 464, 505, 507, 383

[56] References Cited

U.S. PATENT DOCUMENTS

| | | | |
|---|---|---|---|
| 453,055 | 5/1891 | Ware | 239/222.17 |
| 1,405,810 | 2/1922 | Wilkie | 239/390 |
| 1,801,459 | 4/1931 | Slauter | 239/505 |
| 4,121,769 | 10/1978 | Drori | 239/222.17 |
| 4,512,519 | 4/1985 | Uzrad | 239/381 |

*Primary Examiner*—Andres Kashnikow
*Assistant Examiner*—Patrick N. Burkhart
*Attorney, Agent, or Firm*—Benjamin J. Barish

[57] ABSTRACT

A liquid sprinkler comprises a nozzle, a bridge including an outer section overlying the nozzle, and a rotor in alignment with the nozzle bore so as to be impinged by the water jet issuing therefrom. The outer bridge section includes a deflector surface aligned with the nozzle bore and having an enlarged area such that when the deflector surface is impinged by the axial jet from the nozzle bore, it produces an annular spray laterally of the sprinkler, whereby the sprinkler may be converted from a rotary sprinkler producing a rotating jet, to a static sprinkler producing an annular spray by merely removing the rotor from the nozzle and permitting the jet to impinge on the deflector surface area of the outer bridge section.

11 Claims, 4 Drawing Figures

FIG. 1
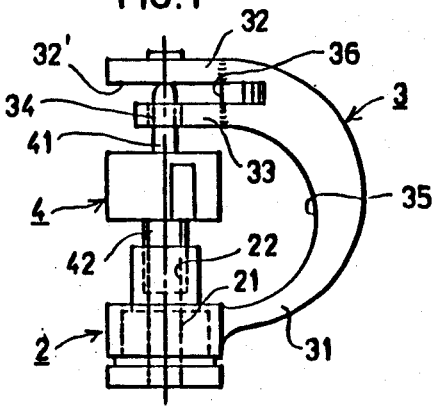
FIG. 2
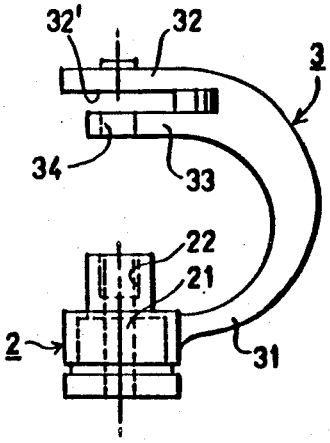
FIG. 3
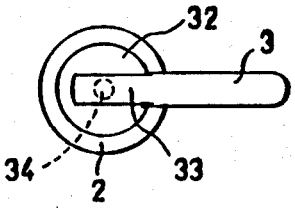
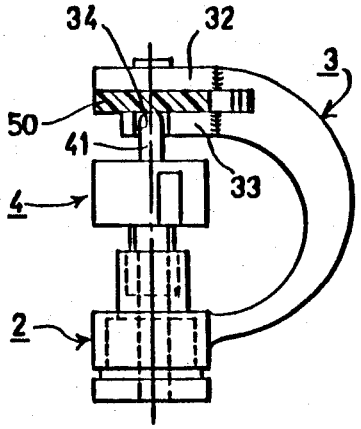
FIG 4

WATER SPRINKLER

CROSS REFERENCE TO RELATED APPLICATIONS

This application is related to U.S. patent application No. 06/631,760 filed July 17, 1984, now U.S. Pat. No. 4,583,689 for "Rotary Sprinkler".

BACKGROUND OF THE INVENTION

The present invention relates to liquid sprinklers, and particularly to water sprinklers commonly used for irrigation purposes.

Many different types of water sprinklers are known. One general type is a rotary sprinkler and includes a rotor for producing a rotating jet laterally of the sprinkler. Another type is a static sprinkler which produces an annular spray or a mist of the water around the sprinkler. Sometimes it is desirable when using a rotary sprinkler to be able to convert it for use as a static sprinkler. Heretofore, where this was possible, it was usually necessary to add a number of parts or otherwise to modify the construction, which was very inconvenient, if practical at all, in the field.

SUMMARY OF THE INVENTION

One object of the present invention is to provide a liquid sprinkler which is easily convertible for use either as a rotary sprinkler or as a static sprinkler. Another object of the invention is to provide a rotary sprinkler which can be easily converted for higher outputs.

According to a broad aspect of the present invention, there is provided a liquid sprinkler comprising a nozzle formed with an axial outlet bore through the liquid issues in the form of an axial jet; a bridge including an inner section secured to the nozzle and extending laterally thereof, and an outer section overlying and spaced from the nozzle bore; and a rotor rotatably received on the nozzle in alignment with its outlet bore so as to be impinged by the water jet issuing therefrom and to be rotated thereby for producing a rotating jet laterally of the sprinkler, the rotor including a spindle engageable with the outer bridge section during the operation of the sprinkler for retaining the sprinkler in the space between the outer bridge section and the nozzle; characterized in that the outer bridge section includes a deflection surface aligned with the axial bore and having an enlarged area substantially larger than that of the axial jet such that when the deflector surface is impinged by the axial jet, it produces an annular spray laterally of the sprinkler, whereby the sprinkler may be converted from a rotary sprinkler producing a rotary jet, to a static sprinkler producing an annular spray by merely removing said rotor from the nozzle and permitting the axial jet to impinge on the deflector surface of the outer bridge section.

The bridge further includes an intermediate section underlying the outer bridge section and formed with an opening therethrough aligned with the nozzle axial bore for receiving the spindle of the rotor, said opening being of larger cross-sectional area than that of said axial jet so as to not be impinged by the axial jet when flowing therethrough upon removal of said rotor.

According to a further feature in the described preferred embodiment, the sprinkler further includes an insert frictionally received between the outer and intermediate bridge sections and engageable with the spindle of the rotor when the sprinkler is operated as a rotary sprinkler, to decrease the abrasion caused thereby to the outer bridge section, and also to decrease the rotary velocity of the rotor because of the frictional loading thereof by the insert, both of which enable the output of the sprinkler to be substantially increased Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view illustrating one form of rotary sprinkler constructed in accordance with the present invention.

FIG. 2 is a view similar to that of FIG. 1, but showing the sprinkler converted for use as a static sprinkler by the removal of its rotor FIG. 3 is a top plan view of the sprinkler of FIG. 2; and FIG. 4 is a side elevational view of the sprinkler of FIG. 1 modified to increase the output of the sprinkler.

DESCRIPTION OF PREFERRED EMBODIMENTS

The sprinkler illustrated in FIGS. 1–3 of the drawings is of the general type as described in patent application No. 06/631,760. It includes three main parts, namely a nozzle 2 formed with an axial outlet bore through which the liquid issues in the form of an axial jet, a bridge 3 fixed to the nozzle, and a rotor 4 rotatably received on the nozzle in alignment with its outlet bore so as to be impinged by the water jet issuing from the nozzle. The rotor 4 is thus rotated by the axial jet and deflects it to produce a rotating jet laterally of the sprinkler.

Both the nozzle 2, and the rotor 4, may be of the same construction as described in the above-cited patent application No. 06/631,760, but this is not essential as the present invention could also be advantageously used with nozzles and rotors of other constructions.

The present invention is concerned primarily with the construction of bridge 3, and therefore the remainder of the description will be directed to this construction. Briefly, bridge 3 is constructed so as to enable the sprinkler to be converted from a rotary sprinkler producing a rotating jet laterally of the nozzle, to a static sprinkler producing an annular spray of droplets or mist around the sprinkler, by merely removing the rotor 4. Bridge 3 is of a construction which also permits the sprinkler output to be substantially increased without causing abrasion damage or high-speed rotation of the rotor, both of which result when increasing the output of existing sprinkler constructions.

Thus, bridge 3 includes an inner section 31 secured to nozzle 2 and extending laterally thereof, and an outer section 32 overlying and spaced from the nozzle bore 21 through which the liquid issues in the form of an axial jet to impinge rotor 4. The latter rotor is formed with a spindle 41 at its upper end engageable with the underface of bridge extension 32, the lower end of the rotor being provided with a stem 42 rotatably received within a cylindrical socket 22 formed in nozzle 2, all as described in the above-cited patent application.

However, whereas in the above-cited patent application, the upper stem 41 is rotatably received within a socket formed in the underface of the outer bridge section 32, in the sprinkler illustrated in FIGS. 1-3, the underface of bridge section 32 is flat, and the rotor is rotatably retained in place by means of an intermediate bridge section 33 underlying the outer bridge section 32 and formed with an opening 34 aligned with the nozzle axial bore 21 for receiving the rotor spindle 41. Opening 34 formed through the intermediate bridge section 33 is of larger cross-sectional area than that of the axial jet flowing through nozzle bore 21 so as not to be impinged by the axial jet when flowing therethrough upon removal of rotor 4, as shown in FIG. 2.

In addition, the upper bridge section 32 is of enlarged area as compared to the construction in the above-cited patent application, substantially larger than the cross-sectional area of the axial jet from nozzle bore 21. The arrangement is such that when rotor 4 is removed, as shown in FIG. 2. the axial jet flowing through opening 34 of the intermediate bridge section 33 impinges against the underface of the outer bridge section 32; this underface forms a deflector surface 32' which deflects the water laterally according to the Bernuolli effect, to produce an annular spray of fine droplets or mist laterally around the sprinkler. This enlarged deflector surface 32' on the underface of the outer bridge section 32 is preferably flat and of circular configuration, as illustrated particularly in FIG. 3.

As described in the above-cited patent application, the portion 35 of bridge 3 laterally of rotor 4 is formed with a sharpened edge (not shown) in order to minimize the portion of the rotating jet produced by rotor 4 which impinges the bridge. Similarly, the portion of bridge 3 joining its upper bridge section 32 with its lower bridge section 33 is also formed with a pointed edge, as shown as 36, in order to minimize the portion of the annular spray impinged by this part of the bridge when the rotor 4 is removed.

It will be seen that the sprinkler illustrated in FIGS. 1-3 may be used in the following manner.

First, the sprinkler may be operated as a normal rotating sprinkler by including rotor 4, whereupon the axial jet issuing from nozzle bore 21 impinges the rotor to produce a well-defined rotating jet laterally of the sprinkler in the same manner as described in the above-cited patent application.

However, the illustrated sprinkler may be converted to a static sprinkler for producing an annular spray or mist by merely removing rotor 4, as shown in FIG. 2. In this condition of the sprinkler, the axial jet issuing from bore 21 passes through opening 34 of the intermediate bridge section 33 and impinges against the deflector underface 32' of the outer bridge section 32. As indicated earlier, opening 34 is of larger cross-sectional area than that of the jet so that this opening does not interfere with the jet as it passes through and impinges against the deflector underface of the outer bridge section 32. Deflector surface 32' is of enlarged area and is effective to deflect the impinging jet laterally on all sides, substantially parallel to deflector surface 32' because of the Bernoulli effect, so that the result is an annular spray of fine water droplets or mist as produced by a static sprinkler.

It will thus be seen that the sprinkler illustrated in FIGS. 1 and 2 may be used as a conventional rotary sprinkler producing a rotating jet laterally of the sprinkler by including the rotor 4, and may be conveniently converted to a static sprinkler for producing an annular spray or mist by merely removing the rotor 4.

The illustrated sprinkler can also be adapted for higher outputs if desired. Thus, two effects limit a conventional rotary sprinkler from being operated to produce outputs higher than that for which the sprinkler was designed: First the rotor is caused to rotate at a higher speed, thereby producing a "whirling" which substantially decreases the range of the sprinkler and effectively destroys the rotating jet produced thereby; in addition, the increased force applied by the rotor against the outer bridge section (e.g. 32 in FIG. 1) rapidly increases the abrasion of the latter, thereby substantially decreasing the useful life of the sprinkler.

The sprinkler illustrated in FIGS. 1-3, however, may be adapted for larger outputs by merely inserting a disc 50 (FIG. 4), such as of natural or synthetic rubber, between the outer bridge section 32 and the intermediate bridge section 33. Disc 50 is of the same thickness as, or slightly larger than, the distance between the two bridge sections, so as to be firmly retained between them by friction. Thus, when the output of the sprinkler is increased beyond its rated value, disc 50 protects the underface of bridge section 32 from abrasion, and also frictionally loads rotor 4 so as to decrease the rotational speed of the rotor, thereby enabling the sprinkler also to be used for increased outputs.

It will be appreciated that many variations and modifications may be made. For example, instead of including only one bridge 3, the sprinkler could include two or more. Also, the deflector underface of the outer bridge section 32, instead of being flat, could be formed with a plurality of grooves radiating from its center so as to "bunch" the detlected water issuing therefrom to form an annual array of "streams" eminating from the center of the deflector. Many other variations, modifications and applications of the invention will be apparent.

I claim:

1. A liquid sprinkler, comprising:

a nozzle formed with an axial outlet bore through which the liquid issues in the form of an axial jet;

a bridge including an inner section secured to the nozzle and extending laterally thereof, and an outer section overlying and spaced from the nozzle bore;

and a rotor rotatably received on the nozzle in alignment with its outlet bore so as to be impinged by the water jet issuing therefrom and to be rotated thereby for producing a rotating jet laterally of the sprinkler, said rotor including a spindle engageable with said outer bridge section during the operation of the sprinkler for retaining the rotor in the space between said outer bridge section and the nozzle;

said bridge further including an intermediate section underlying said outer bridge section and formed with an opening there-through aligned with said nozzle bore for receiving the spindle of the rotor, said opening being of larger cross-sectional area than that of said axial jet so as not to be impinged by the axial jet when flowing therethrough upon removal of said rotor;

said outer bridge section including a deflector surface aligned with said axial bore and said opening through said intermediate section, and having an enlarged area substantially larger than that of said axial jet such that when said deflector surface is impinged by said axial jet, it produces an annular spray laterally of the sprinkler, whereby the sprinkler may be converted from a rotary sprinkler producing a rotating jet, to a static sprinkler producing an annular spray by merely removing said rotor from the nozzle and permitting the axial jet to impinge on said deflector surface area of the outer bridge section.

2. The sprinkler according to claim 1, wherein the juncture of said outer and intermediate bridge sections is formed with a sharpened edge.

3. The sprinkler according to claim 1, wherein said deflector surface of said outer bridge section is of circular configuration.

4. The sprinkler according to claim 3, wherein said deflector surface of said outer bridge section flat.

5. The sprinkler according to claim 1, further including an insert frictionally received between said outer and intermediate bridge sections and engageable with the spindle of said rotor when the sprinkler is operating as a rotary sprinkler, said insert being effective to decrease the abrasion closed by the rotor spindle to the outer bridge section and thereby to permit the output of said sprinkler to be increased.

6. The sprinkler according to claim 5, wherein said insert is of resilient material effective to be compressed by said rotor spindle and thereby to frictionally load the rotor to decrease its rotary velocity when the output of the sprinkler is increased.

7. A liquid sprinkler, comprising:

a nozzle formed with an axial outlet bore through which the liquid issues in the form of an axial jet;

a bridge including an inner section secured to the nozzle and extending laterally thereof, and an outer section overlying and spaced from the nozzle bore;

and a rotor rotatably received on the nozzle in alignment with its outlet bore so as to be impinged by the water jet issuing therefrom and to be rotated thereby for producing a rotating jet laterally of the sprinkler, said rotor including a spindle engageable with said outer bridge section during the operation of the sprinkler for retaining the rotor in the space between said outer bridge section and the nozzle;

said outer bridge section including a deflector surface aligned with said axial bore and having an enlarged area substantially larger than that of said axial jet such that when said deflector surface is impinged by said axial jet, it produces an annular spray laterally of the sprinkler;

said bridge further including an intermediate section underlying said outer bridge section and formed with an opening thereto aligned with said nozzle bore for receiving the spindle of the rotor, said opening being of larger cross-sectional area than that of said axial jet so as not to be impinged by the axial jet when flowing therethrough upon removal of said rotor;

the juncture of said outer and intermediate bridge sections being formed with a sharpened edge.

8. The sprinkler according to claim 7, wherein said deflector surface of said outer bridge section is of circular configuration.

9. The sprinkler according to claim 7, wherein said deflector surface of said outer bridge section flat.

10. The sprinkler according to claim 7, further including an insert frictionally received between said outer and intermediate bridge sections and engageable with the spindle of said rotor when the sprinkler is operating as a rotary sprinkler, said insert being effective to decrease the abrasion caused by the rotor spindle to the outer bridge section and thereby to permit the output of said sprinkler to be increased.

11. The sprinkler according to claim 10, wherein said insert is of resilient material effective to be compressed by said rotor spindle and thereby to frictionally load the rotor to decrease its rotary velocity when the output of the sprinkler is increased.

* * * * *